US005692995A

United States Patent [19]

Alvarez et al.

[11] Patent Number: 5,692,995

[45] Date of Patent: Dec. 2, 1997

[54] SKI SIMULATING EXERCISE MACHINE

[75] Inventors: Matias J. Alvarez, Park City; Vladimir Sarpe, West Valley City, both of Utah

[73] Assignee: Dennis D. Palmer, Draper, Utah

[21] Appl. No.: 546,399

[22] Filed: Oct. 20, 1995

[51] Int. Cl.[6] ..... A63B 69/18

[52] U.S. Cl. ..... 482/71; 434/253

[58] Field of Search ..... 482/70, 71, 51, 482/148, 79, 80, 52; 601/29, 31, 32, 33, 34–36; 434/253

[56] References Cited

U.S. PATENT DOCUMENTS

| | | | |
|---|---|---|---|
| 3,659,842 | 5/1972 | Aijala . | |
| 3,787,047 | 1/1974 | Brawn . | |
| 4,396,189 | 8/1983 | Jenkins . | |
| 4,595,195 | 6/1986 | Miehlich . | |
| 4,645,202 | 2/1987 | Tomba et al. . | |
| 4,669,723 | 6/1987 | Arsenian . | |
| 4,846,463 | 7/1989 | Kleinnibbelink . | |
| 5,188,577 | 2/1993 | Young et al. . | |
| 5,284,460 | 2/1994 | Miller et al. | 482/71 |
| 5,536,225 | 7/1996 | Neuberg et al. | 482/71 |

*Primary Examiner*—Stephen R. Crow

*Attorney, Agent, or Firm*—R. Mallinckodt; T. Crellin

[57] ABSTRACT

An exercise machine that simulates the movements made during snow skiing and has a pair of foot support arms mounted for limited rotational movement about separate axes of rotation so that foot support portions of the foot support arms move simultaneously both vertically and horizontally, coordinates simultaneous movement of both foot support arms through a gear train coupling the foot support arms. In addition, foot support treads which support the feet of a user of the machine are resiliently mounted to the foot support arms to allow angling of the foot support treads to simulate a feeling of edging of skis.

20 Claims, 5 Drawing Sheets

SKI SIMULATING EXERCISE MACHINE

BACKGROUND OF THE INVENTION

1. Field

The invention is in the field of ski simulating exercise machines wherein a pair of foot support arms having foot support treads are mounted for limited rotation about respective axes of rotation and the movement of such arms is coordinated in a desired manner.

2. State of the Art

An exercise machine which simulates movements made during snow skiing and which includes a pair of foot support arms with foot support treads that each move simultaneously both vertically and laterally is disclosed in pending application Ser. No. 327,365. In that application, hydraulic means are shown for coordinating movement of the foot support arms so that when one arm moves, the other arm also moves in the same horizontal direction. The foot support treads are secured to the end portion of the foot support arms.

SUMMARY OF THE INVENTION

According to the invention, an exercise machine having a pair of foot support arms which pivot about respective axes of rotation includes a gear train coupling the foot support arms to coordinate simultaneous movement of such arms. Each arm is mounted for limited rotational movement about a separate axis of rotation. To achieve the desired preferred movement of the arms, each axis of rotation will generally extend along the intersection of perpendicular planes, one plane for each axis of rotation being substantially perpendicular to a machine central plane and the other planes for each axis of rotation intersecting one another. Each foot support arm has a gear associated therewith which rotates with the arm about its axis of rotation. At least one gear is positioned between the gears associated with the foot support arms so that all of the gears rotate together in a coordinated manner. An adjustable resistance means is coupled to the gear train to provide adjustable resistance to movement of the foot support arms to adjust the effort required to move the arms and thus the amount of exercise expended.

In a preferred embodiment of the invention, each foot support arm includes a shaft secured to and extending from one end of the arm to rotate with the arm. The machine includes means for mounting the respective shafts wherein the shafts form the axes of rotation for the foot support arms. Gears are secured to each of the shafts and an idle gear is rotatably mounted between the shaft mounted gears in engagement therewith so that as one shaft is rotated, the gears rotate so that both arms move simultaneously. A pulley may be mounted on the idle gear with a stationary belt positioned around the pulley to resist rotation of the pulley and thus, rotation of the gears and the foot support arms. The tightening of the belt against the pulley may be adjusted to adjust the resistance to movement of the foot support arms. Various other resistance means may be used such as a brake disc with adjustable brake disc pads.

The foot treads are adjustably mounted on the foot support arms so their positions along the arms may be changed. In addition, a resilient mounting may be provided for the foot support treads so that the treads have some resilient give which allows the angling of the treads with respect to the foot support arms to provide a feeling of edging of skis, particularly toward and at the end points of the side-to-side movement of the foot support arms. This further adds to the simulation of skiing movements.

THE DRAWINGS

The best mode presently contemplated for carrying out the invention is illustrated in the accompanying drawings, in which:

FIG. 1, a perspective view of an exercise machine of the invention;

FIG. 2, a fragmentary vertical section taken on the line 2—2 of FIG. 1;

FIG. 3, a fragmentary vertical section taken on the line 3—3 of FIG. 2;

FIG. 4, an exploded, fragmentary assembly view of a foot tread mounting of the invention;

FIG. 5, a fragmentary rear view of the foot treads of an exercise machine of the invention with the tread mountings of FIG. 4, showing how the treads may be angled with such mountings;

FIG. 6, a fragmentary side elevation of a foot support arm showing an alternate embodiment of a foot tread; and FIG. 7, a vertical section taken on the line 7—7 of FIG. 6.

DETAILED DESCRIPTION OF THE ILLUSTRATED EMBODIMENTS

Figure 1:
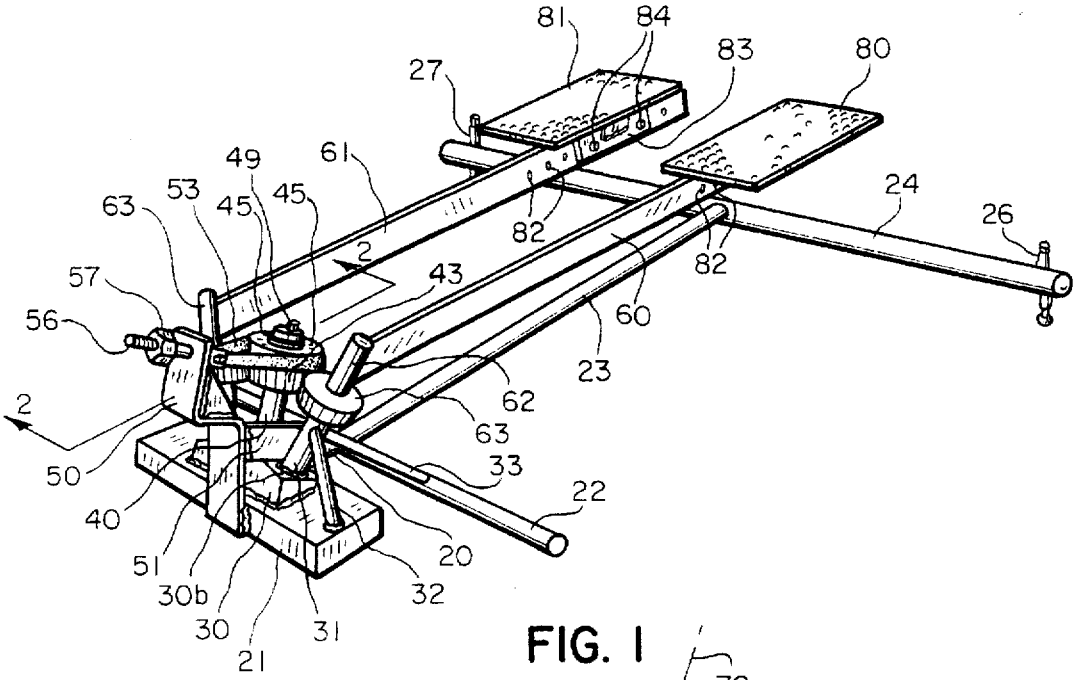
Figure 2:
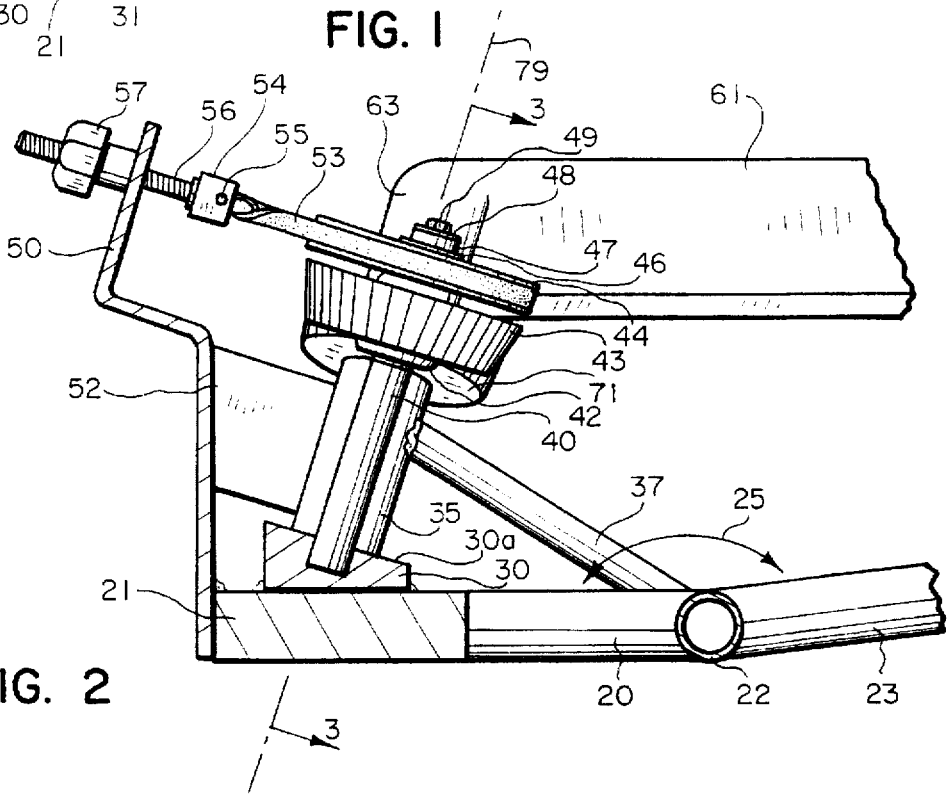

Referring to FIGS. 1 and 2, an exercise machine of the invention includes a tubular forward central base member 20 which extends rearwardly from headblock 21 to connection with forward tubular cross member 22. A tubular central base member 23 extends from forward cross member 22 to connection with rear cross member 24. This configuration forms a solid, stable base for the machine. It is preferred that forward central base member 20 and central base member 23 be secured to forward cross member 22 at an angle 25, FIG. 2, of less than 180° and that rear cross member 24, FIG. 1, be provided at opposite end portions with height adjustment legs 26 and 27 whose positions can be adjusted to adjust the height of rear cross member 24 above a surface on which the machine is supported. The angle 25 is important so that regardless of the height of rear cross member 24 through a normal range of adjustment, forward cross member 22 remains on the surface supporting the machine. An angle of about 172° has been found satisfactory for angle 25.

If desired, central base member 23 can be constructed of multiple telescoping pieces so the length of member 23 can be adjusted for desired stability, or for transportation or storage.

Headblock 21 has shaft mounting block 30 secured thereto, such as by welding. Shaft mounting block 30 has a central top surface 30*a*, FIG. 2, sloped rearwardly, a left side top surface 30*b* (FIGS. 1 and 3) sloped both rearwardly and downwardly toward the left side of the machine (left side looking from the rear of the machine as a user would stand on it), and a right side top surface 30*c* sloped both rearwardly and downwardly toward the right side of the machine. Left sleeve 31 is secured in shaft mounting block 30 so that it extends therefrom substantially perpendicularly to left side top surface 30*b*. A brace 32 is welded between sleeve 31 and headblock 21 and brace 33 is welded between sleeve 31 and forward cross member 22 to strengthen the frame of the machine and rigidly hold sleeve 31 in place. Similarly, right sleeve 35 is secured in shaft mounting block 30 so that it extends therefrom substantially perpendicularly to right side top surface 30*c*. A brace 36 is welded between sleeve 35 and headblock 21 and brace 37 is welded between sleeve 35 and forward cross member 22. A shaft 40 is secured in and extends, substantially perpendicularly, from central top surface 30*a*. Shaft 40 includes shoulder 41 intermediate its length upon which washer 42 and gear 43 are supported so that gear 43 is free to rotate with respect to shaft 40. A smaller diameter upper portion of shaft 40 above shoulder 41 extends through washer 42, gear 43, and a pulley 44. Pulley 44 is secured to gear 43 by screws 45 which extend through pulley 44 and are threaded into gear 43 so that pulley 44 will rotate with gear 43. Gear 43 and pulley 44 are held in place on shaft 40 against washer 42 and shoulder 41 by washer 46, spacer 47, washer 48, and bolt 49 threaded into the end of shaft 40. The spacing is such that with bolt 49 tightened onto the end of shaft 40, gear 43 and attached pulley 44 are held in position on shaft 40 substantially against washer 42 and shaft shoulder 41 but are free to rotate on shaft 40 between shoulder 41 and bolt 49.

Resistance mounting bracket 50 is secured to and extends upwardly from headblock 21 and is reinforced by braces 51 and 52 which extend from resistance mounting bracket 50 to sleeves 31 and 35, respectively. A resistance belt 53 extends partially around pulley 44 with the ends of the resistance belt secured to belt termination fitting 54 by pin 55. Belt termination fitting 54 is secured to the end of threaded rod 56 which extends through the upper portion of resistance mounting bracket 50 with knob 57 threaded thereon and abutting resistance mounting bracket 50 on its side opposite the side facing the termination fitting so that as knob 57 is rotated in one direction, threaded rod 56 is drawn through bracket 50 drawing termination bracket 54 toward mounting bracket 50 to tighten belt 53 about pulley 44. This increases the resistance to turning applied to pulley 44. When knob 57 is rotated in the opposite direction, termination fitting 54 can move away from mounting bracket 50 and belt 53 is loosened about the pulley to reduce the resistance to turning. Belt 53 may be a flat resistance belt which mates with a flat bottomed groove in pulley 44.

The type of resistance means used is not critical and various resistance means could be used. Rather than a pulley and resistance belt, a brake disc with adjustable brake disc shoes to set the resistance or various combinations of pressure plates, springs and washers could be used.

Figure 3:
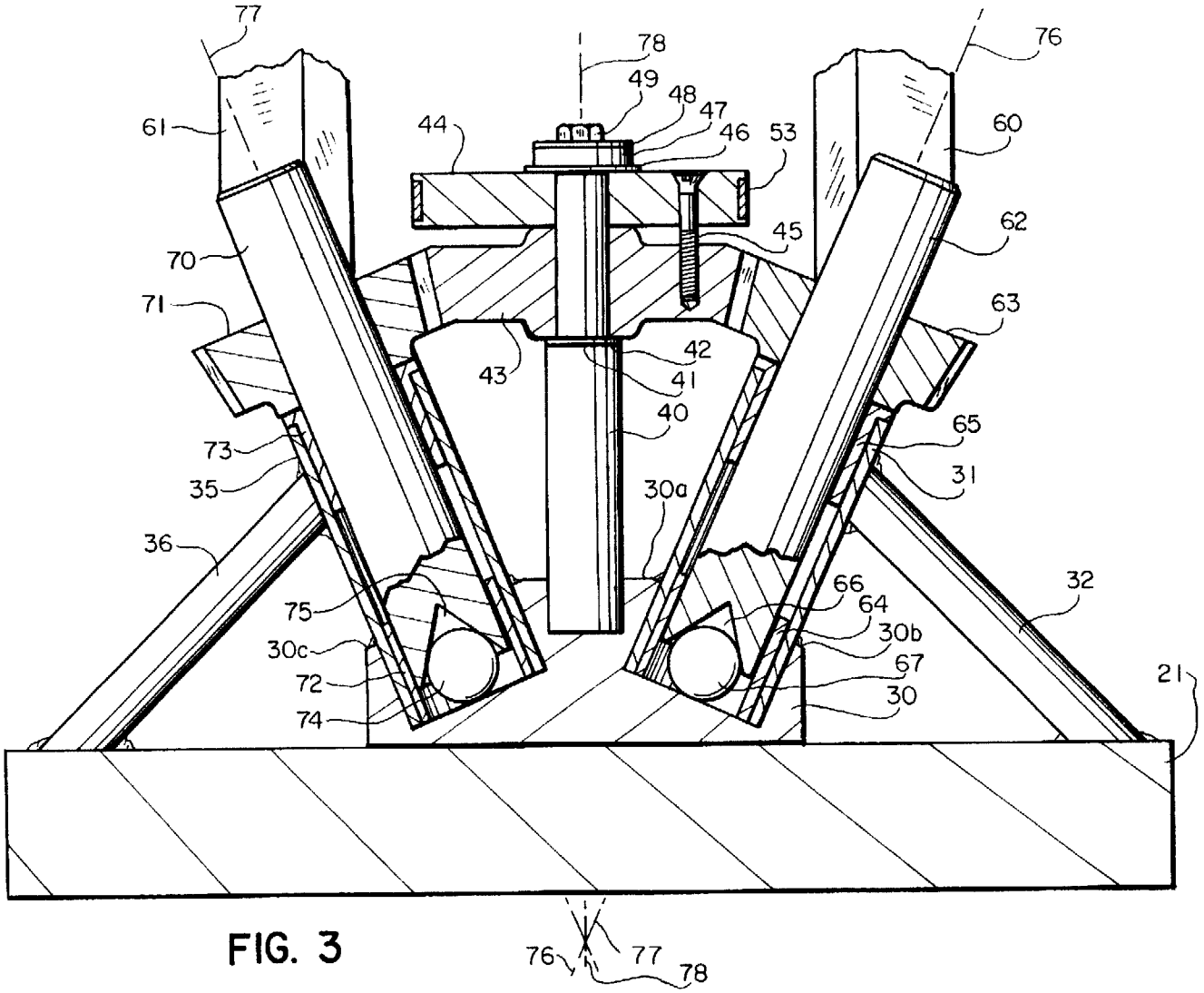

Foot support arms 60 and 61 are pivotally mounted to the machine at their forward ends. For this purpose, shaft 62, FIGS. 1 and 3, is secured to the forward end of foot support arm 60, such as by welding, and extends downwardly therefrom. A bevel gear 63 is secured to shaft 62 immediately below foot support arm 60, and shaft 62 is rotatably received in left sleeve 31. Bushings 64 and 65 are inserted in sleeve 31 to serve as bearings and the bottom of shaft 62 is configured, here shown as a conical opening 66, to receive a ball bearing 67 therein which rests against block 30 in the bottom of sleeve 31 to support shaft 62 in sleeve 31 and allow it to substantially freely rotate in sleeve 31.

Similarly, shaft 70 is secured to the forward end of foot support arm 61 and extends downwardly therefrom with bevel gear 71 secured thereto immediately below foot support arm 61. Shaft 70 is received in bushings 72 and 73 in right sleeve 35 and is supported in sleeve 35 by ball bearing 74 received in conical bottom opening 75. Thus, shaft 70 is substantially freely rotatable in sleeve 35.

With shafts 62 and 70 received in sleeves 31 and 35, respectively, bevel gears 63 and 71 will mate with gear 43 which serves as an idle gear. Thus, when foot support arm 60 and shaft 62 rotate, gear 63 secured to shaft 62 rotates causing rotation of idle gear 43. Rotation of idle gear 43 causes rotation of gear 71 which causes coordinated rotation of shaft 70 and foot support arm 61. Similarly, movement of foot support arm 61 will cause movement of gear 71, which in turn causes movement of idle gear 43 and gear 63 secured to shaft 62, thereby causing rotation of foot support arm 60. In this way movement of arms 60 and 61 are coordinated so that such arms move simultaneously. This coordination is through a gear train rather than through the hydraulic system described in the referenced application. The use of a gear train to coordinate movement of the foot support arms has been found less expensive than the use of the hydraulic piston and cylinder assemblies. Resistance to movement is adjusted by operating knob 57 to adjust the tension of resistance belt 53 about pulley 44. This adjusts the effort required by a user of the machine in moving the foot support arm from side-to-side.

Shafts 62 and 70 are located along, and therefore foot support arms 60 and 61 rotate about, axes that are each defined by the intersection of a pair of perpendicular planes, one plane of each pair being substantially perpendicular to a machine central plane and the other plane of each pair intersecting one another. The intersecting planes are represented in FIG. 3 by broken lines 76 and 77 while the machine central plane is shown by line 78. The respective planes extend into and out of the page along these lines. The planes substantially perpendicular to the central plane is shown by broken line 79 in FIG. 2 and extends into and out of the page. In the illustrated embodiment, the two planes substantially perpendicular to the central plane coincide and form a single plane 79. This does not always have to be the case, however. This plane 79 can be vertically oriented or sloped with respect to vertical. As shown in FIG. 2 for the illustrated embodiment, plane 79 may be sloped rearwardly with respect to vertical.

Foot support treads 80 and 81 are secured to the end portion of foot support arms 60 and 61, respectively, and form the foot support portions of the respective foot support arms to support the feet of the user of the machine. In some instances, for users of different heights or build, it may be desirable to adjust the position of the foot support treads along the length of the foot support arms. Thus, as shown in FIG. 1, both foot support arms 60 and 61 are provided with a plurality of adjustment holes 82 along the rear portion thereof. Mounting bracket 83 secured to the underside of foot tread 81 is slidably received on foot support arm 61, and bolts or other pins 84 pass through receiving holes in bracket 83 and through selected adjustment holes 82 in foot support arm 61 to position bracket 83 as desired along foot support arm 61. A similar bracket is secured to foot support tread 80 and similarly adjustably secures foot support tread 80 to foot support arm 60. However, such bracket is not visible below foot support tread 80 in FIG. 1 because of the angle of such figure.

Figure 4:
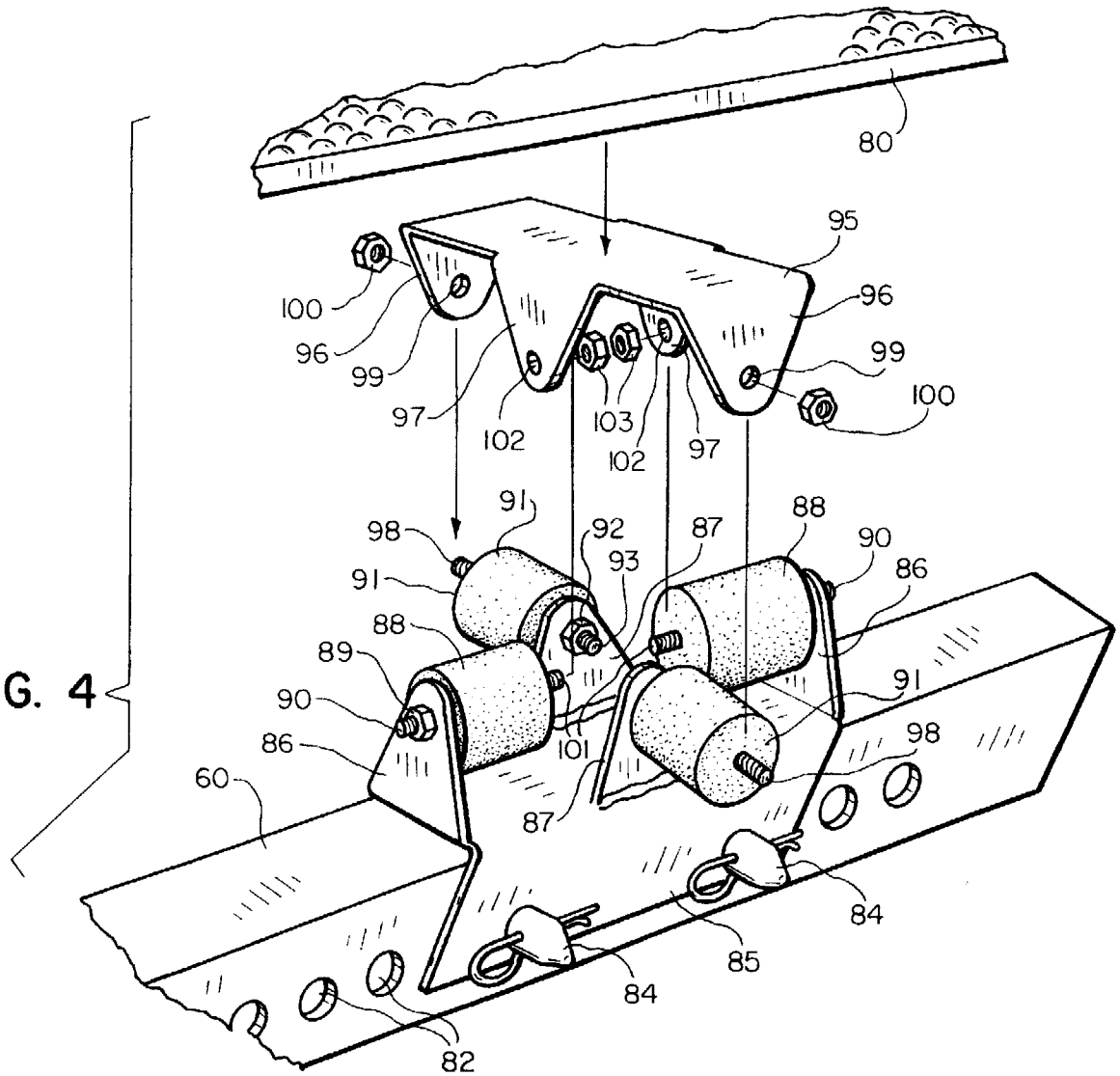
Figure 5:
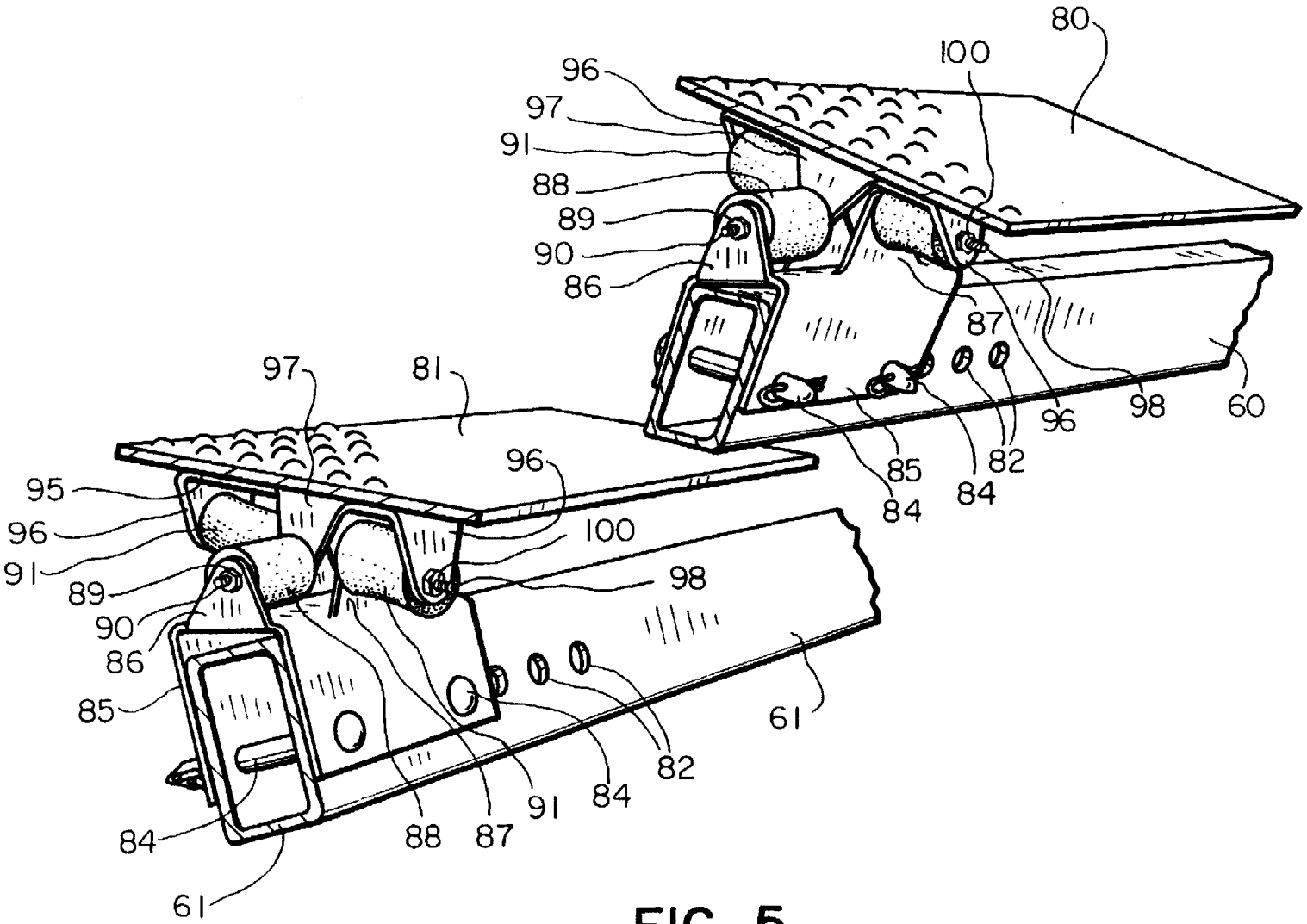

With the foot support tread mounting shown in FIG. 1, the mounting brackets 83 are configured such that, or the attachment of brackets 83 to the foot support treads is such that, the foot support treads are maintained substantially level with the horizontal machine supporting surface over their entire range of movement. However, in some cases, it has been found desirable to resiliently mount the foot support treads to the foot support arms. Thus, FIGS. 4 and 5 show a resilient foot support tread mounting of the invention. This is shown as a substitute for the mounting bracket 83 shown in FIG. 1. FIG. 4 shows the bracket in association with foot support tread 80 and foot support arm 60. A similar mounting is used in connection with foot support tread 81 and foot support arm 61 and is shown with the same reference numbers in FIG. 5. With the resilient mounting of the foot support treads, bracket 85 of generally U-shape configuration fits over foot support arm 60 and has tabs 86 extending upwardly from the ends thereof and tabs 87 extending upwardly from the sides thereof intermediate the length of the sides. Rubber stud bumpers 88, such as those sold by McMaster-Carr under number 9378K14, are secured to tabs 86 by nuts 89 threaded onto studs 90 extending from the bumpers 88 through receiving holes in tabs 86. The bumpers 88 secured to tabs 86 extend toward one-another. Similar rubber stud bumpers 91 are secured to tabs 87 by nuts 92 threaded onto studs 93 which extend through holes in tabs 87. Bumpers 91 extend outwardly from tabs 87. An elongate mounting plate 95 having a configuration similar to the top of bracket 85 has tabs 96 extending from the ends thereof and tabs 97 extending from the sides thereof intermediate their length. Mounting plate 95 is oriented so that studs 98 extending outwardly from bumpers 91 extend through holes 99 in end tabs 96 and are secured thereto by nuts 100. Studs 101 extending inwardly from the ends of bumpers 88 extend through holes 102 in side tabs 97 and are secured by nuts 103. Foot support tread 80 is secured to mounting plate 95. In this way, foot support tread 80 is resiliently secured to foot support arm 60. Foot support tread 81 is secured to foot support arm 61 in the same manner, as shown by FIG. 5. As will be noted, bracket 85 is configured so that it provides a level surface from which tabs 86 and 87 extend to compensate for the angled orientation of foot support arms 60 and 61. However, such leveling of the foot support treads could be accomplished by different configurations of the tabs or by the mounting of top bracket 95 to the foot support treads.

The resilient mounting of the foot support treads 80 and 81 is advantageous because it allows the treads to move (rotate) or angle slightly from side-to-side about the axis of the foot support arms. This allows a user to apply pressure to the foot support treads during movement of the treads from side-to-side during use of the machine to rotate or angle the foot support treads inwardly as the treads reach the end of their side-to-side horizontal travel. This slight inward angling is shown in FIG. 5 as the ends of foot support arms 60 and 61 and foot support treads 80 and 81 move toward their leftmost extent of horizontal travel in FIG. 5. This angling will occur with pressure applied by the user's feet on the treads, such feet not being shown in FIG. 5. Opposite angling would occur at the rightmost extent of horizontal travel. If feet are not present to apply force to cause the angling, the treads would remain level. This resilience provides the feel of edging a pair of skis as the skis are moved from side-to-side during turning of the skis, the same side-to-side movement that is simulated by the side-to-side movement of the foot treads of the machine. Thus, the resilient mounting enhances the simulation of skiing provided by the machine. As will be apparent from FIG. 5, this side angling causes some rotation of the rubber bumpers 88 and a bending of the rubber bumpers 91. This side-to-side angling of the foot support treads along the axis of the foot support arms is the most desirable resilient movement to provide for the foot treads. With the embodiment shown, however, some resilient front-to-back movement of the foot treads is also provided for. This can be advantageous in training for proper weight distribution and balance during skiing. With front-to-back resilience, rotation of the rubber bumpers 91 occurs along with bending of the rubber bumpers 88. Thus, the resilient mounting shown in FIGS. 4 and 5 provides resilience in substantially all directions. Resilience could be provided in only one or the other directions, if desired, and other methods of providing the desired resilience could be used.

Figure 6:
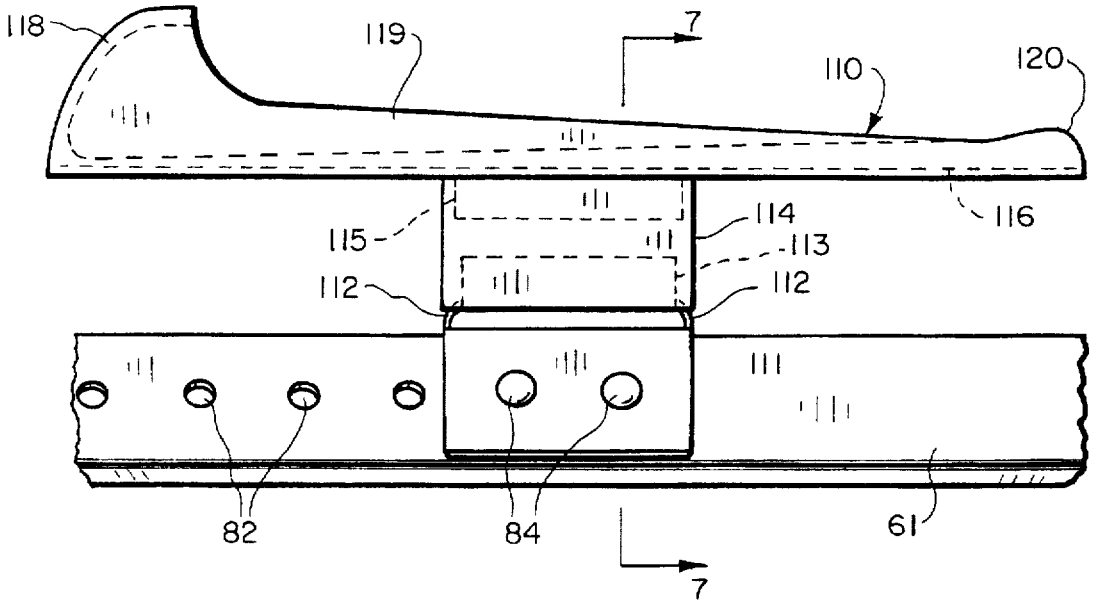
Figure 7:
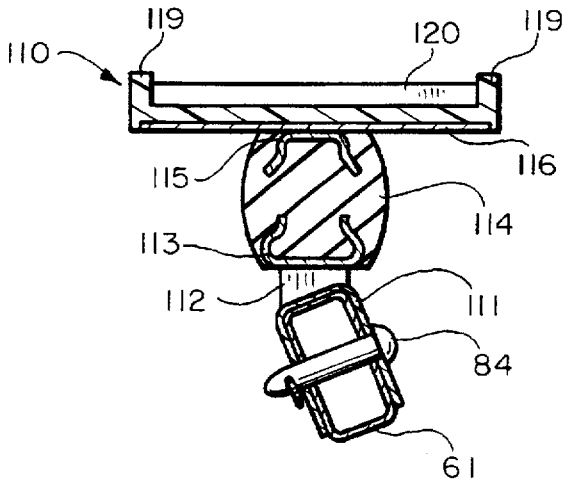

An alternate foot tread mounting is shown in FIGS. 6 and 7, and is shown just for the foot tread 110 mounted on foot support arm 61. A similar foot tread and mounting is provided for foot support arm 60. A U-shaped bracket 111 is adjustably mounted on arm 61 by pins 84 as in the previous embodiments. Mounting tabs 112 are secured, such as by welding, to opposite ends of bracket 111, and extend upwardly to form, preferably as a single steel piece, insert 113. Insert 113 is embedded in rubber or similar material 114 and forms the lower edge thereof. Rubber material 114 extends upwardly and embeds steel insert 115 therein along its upper edge. Insert 115 is secured to tread support 116. Inserts 113 and 115 are configured to extend into rubber material 114 to be securely held therein. However, they are separated by such rubber material 114 so that the rubber material 114 provides a resilient connection between inserts 113 and 115. Further, inserts 113 and 115 may be configured, as shown, so that one can receive the other at least partially therein if the rubber material 114 collapses. A rubber material with a durometer of about 75 has been found satisfactory. When referring to rubber or a rubber material, any resilient material having property similar to natural or synthetic rubber or a number of similar plastics are intended to be included.

As with the foot tread mountings of FIGS. 4 and 5, the mounting of FIGS. 6 and 7 provide a resilient mounting that allows the side-to-side rolling resilience to mimic edging of skis, and provides some forward and backward resilience.

A flat foot tread as shown in FIGS. 4 and 5 may be used with the mounting of FIGS. 6 and 7, or the special foot tread 110 having a toe holding forward portion 118, side flanges 119, and a rear lip 120 may be used to accept a user's shoe and hold it more securely than the flat foot treads 80 and 81 of the prior embodiments. The foot tread 110 is secured to tread support 116 by any suitable means such as an adhesive or by fasteners such as screws.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An exercise machine comprising:

a pair of elongate foot support arms;

means for mounting each of the foot support arms for limited rotational movement about a separate axis of rotation, said rotational movement of the foot support arms causing foot support portions of said foot support arms to move simultaneously in both horizontal and vertical directions with said vertical movement having opposite orientations for the same direction of horizontal movement whereby when the foot support portions move simultaneously in the same horizontal direction, one foot support portion moves vertically upwardly while the other foot support portion moves vertically downwardly; and a gear train interconnecting each of the foot support arms to coordinate movement of the foot support arms so that the foot support arms move simultaneously in a predetermined coordinated manner.

2. An exercise machine according to claim 1, wherein each foot support arm includes a gear associated therewith that rotates therewith, and at least one gear between the gears associated with the foot support arms so that all gears will rotate together in coordinated manner.

3. An exercise machine according to claim 2, wherein each foot support arm includes a shaft secured to and extending from one end of the arm to rotate with the arm, wherein a machine frame includes a pair of shaft receiving means to rotatably receive the shafts extending from the foot support arm and position such shafts along desired respective axes of rotation, and wherein the gear train includes a gear secured to each shaft, an idle gear, and shaft means mounting the idle gear for rotation and positioning such idle gear between the respective gears attached to each shaft to mesh therewith and transmit rotation of one shaft mounted gear to the other shaft mounted gear.

4. An exercise machine according to claim 3, wherein each of the respective axis of rotation extends along the intersection of perpendicular planes, the machine having a central axis in a central plane, one plane for each axis of rotation being substantially perpendicular to the central plane, and the other planes for each axis of rotation intersecting one another.

5. An exercise machine according to claim 3, additionally including a pulley secured to the idle gear for rotation therewith, and resistance means in adjustable contact with the pulley whereby resistance to rotation of the pulley can be adjusted to thereby adjust the resistance to rotation of the idle gear and resistance to movement of the foot support arms.

6. An exercise machine according to claim 5, wherein the resistance means is a belt extending partially around the pulley with means for adjusting the tension on the belt.

7. An exercise machine according to claim 3, additionally including adjustable resistance means associated with the idle gear whereby adjustment of the resistance means adjusts the resistance to movement of the foot support arms.

8. An exercise machine according to claim 1, additionally including resistance means to adjustably resist movement of the foot support arms.

9. An exercise machine according to claim 1, including foot support treads secured to the foot support arms to form foot support portions to support the feet of a person using the machine, and wherein the foot support treads are adjustably secured along the foot support arms so their positions along the lengths of the arms is adjustable.

10. An exercise machine according to claim 9, wherein the foot treads are resiliently mounted to the foot support arms.

11. An exercise machine according to claim 10, wherein the foot support treads are resiliently mounted to allow the treads to tilt substantially about the axis of the foot support arm to simulate edging of a ski.

12. An exercise machine according to claim 1, wherein the foot treads are resiliently mounted to the foot support arms.

13. An exercise machine according to claim 12, wherein the foot support treads are resiliently mounted to allow the treads to tilt substantially about the axis of the foot support arm to simulate edging of a ski.

14. An exercise machine according to claim 13, including a foot support arm mounting bracket secured to each foot support arm, a foot support tread mounting bracket secured to each foot support tread, and rubber connecting means securing a foot support tread mounting bracket to a foot support arm mounting bracket.

15. An exercise machine comprising:

a pair of elongate foot support arms, each arm having a foot support portion to support a foot of a person using the machine;

means mounting said foot support arms for simultaneous horizontal and vertical movement of the foot support portions thereof with respect to a horizontal surface, said vertical movement having opposite orientations for the same direction of horizontal movement, whereby when the foot support portions move simultaneously in the same horizontal direction, one foot support portion moves vertically upwardly while the other foot support portion moves vertically downwardly; and foot support treads resiliently mounted on the foot support arms to form the foot support portions thereof.

16. An exercise machine according to claim 15, wherein the foot support treads are resiliently mounted to allow the treads to tilt substantially about the axis of the foot support arm to simulate edging of a ski.

17. An exercise machine according to claim 16, including a foot support arm mounting bracket secured to each foot support arm, a foot support tread mounting bracket secured to each foot support tread, and rubber connecting means securing a foot support tread mounting bracket to a foot support arm mounting bracket.

18. An exercise machine according to claim 17, wherein the rubber connecting means includes a plurality of rubber stud bumpers.

19. An exercise machine according to claim 17, wherein the rubber connecting means is a rubber material molded in place between a foot support tread mounting bracket and a foot support arm mounting bracket to resiliently secure the two together.

20. An exercise machine according to claim 15, wherein the food support treads are adjustably secured along the foot support arms so their positions along the lengths of the arms is adjustable.

* * * * *